US007798160B2

(12) United States Patent
Chen

(10) Patent No.: US 7,798,160 B2
(45) Date of Patent: Sep. 21, 2010

(54) SAFELY OPERABLE HANDLE DEVICE FOR AN AUTOMATIC FOLDABLE UMBRELLA

(75) Inventor: Hsia-Hui Chen, No. 7, Lane 41, Zihciang S. Rd., Jhubei City, Hsinchu County (TW)

(73) Assignee: Hsia-Hui Chen, Hsinchu County (TW)

( * ) Notice: Subject to any disclaimer, the term of this patent is extended or adjusted under 35 U.S.C. 154(b) by 0 days.

(21) Appl. No.: 12/467,786

(22) Filed: May 18, 2009

(65) Prior Publication Data

US 2010/0116304 A1 May 13, 2010

(30) Foreign Application Priority Data

Nov. 10, 2008 (CN) ..... 2008 2 0175468 U

(51) Int. Cl.
*A45B 25/16* (2006.01)

(52) U.S. Cl. ..... 135/24; 135/22

(58) Field of Classification Search ..... 135/15.1, 135/20.3, 22, 24
See application file for complete search history.

(56) References Cited

U.S. PATENT DOCUMENTS 5,992,433 A * 11/1999 Chung-Kuang et al. ..... 135/24
6,016,822 A * 1/2000 Lin et al. ..... 135/24
6,170,498 B1 * 1/2001 Wu ..... 135/24
6,196,243 B1 * 3/2001 Chen ..... 135/22
2002/0062850 A1 * 5/2002 Kuo ..... 135/24
2003/0159724 A1 * 8/2003 Wu ..... 135/24
2009/0133729 A1 * 5/2009 Chong ..... 135/20.3
2009/0293925 A1 * 12/2009 You ..... 135/24

* cited by examiner

*Primary Examiner*—David Dunn
*Assistant Examiner*—Danielle Jackson
(74) *Attorney, Agent, or Firm*—Fitzpatrick, Cella, Harper & Scinto

(57) ABSTRACT

A safely operable handle device includes a grip shell coupled to a telescopic central shaft unit, a retained block releasably blocked so as to hold the umbrella in an opened state, a reel member rotatably mounted in the grip shell and biased by a coil spring, a cord reelable on the reel member and coupled to one of a top notch and the retained block, an actuator, and a unidirectional retaining mechanism. Upon application of a pressing force to telescopically fold the central shaft unit, and upon movement of the actuator in response to a stroke movement of a push button, the reel member turns in a counterclockwise direction to reel in the cord, and is prevented from turning in a clockwise direction so as to hold the central shaft unit in position to thereby avoid undesirable extension of the central shaft unit.

11 Claims, 18 Drawing Sheets

SAFELY OPERABLE HANDLE DEVICE FOR AN AUTOMATIC FOLDABLE UMBRELLA

CROSS-REFERENCE TO RELATED APPLICATION

This application claims priority of Chinese Utility Model Application No. 200820175468.4, filed on Nov. 10, 2008, the disclosure of which is herein incorporated by reference.

BACKGROUND OF THE INVENTION

1. Field of the Invention

This invention relates to an automatic foldable umbrella, more particularly to a safely operable handle device for an automatic foldable umbrella.

2. Description of the Related Art

Referring to FIG. 1, a conventional automatic umbrella capable of automatic opening and closing disclosed in Taiwanese Utility Model Publication No. 354874 is shown to include a frame 1, an opening spring 2 mounted in a central shaft 101 of the frame 1, a handgrip 3 mounted on a lower end of the central shaft 101, a control unit 4 mounted in the handgrip 3, and a transmitting mechanism 5 coupling the handgrip 3 to the frame 1. The frame 1 includes the central shaft 101, which has a plurality of telescopic shaft sections, a top hub 102 secured on an uppermost end of the central shaft 101, a runner 103 slidably mounted on the central shaft 101, and a plurality of ribs 104 pivotally mounted between the top hub 102 and the runner 103. The control unit 4 has a biased lever 401 pivotally mounted on the handgrip 3, and a button 402 operable to move the lever 401 such that, when the central shaft 101 is telescopically folded, the lever 401 is brought to engage an upper shaft section 101', and such that, when the button 402 is pressed, the lever 401 is disengaged from the upper shaft section 101' so that the shaft sections of the central shaft 101 are extended upwardly by means of the opening spring 2, and the runner 103 is then moved toward the top hub 102 by means of the transmitting mechanism 5 so as to spread the ribs 104 for opening the umbrella. When it is desired to close the umbrella, the button 402 is pressed, and a lower end of the lever 401 is brought to move a biased plate 403 so as to release a retaining member 501 of the transmitting mechanism 5 from the biased plate 403 to thereby permit downward movement of the runner 103 for collapsing the ribs 104. Subsequently, the central shaft 101 can be pushed down and folded until the upper shaft section 101' reaches the lever 401 and is retained thereby.

However, when pushing down the central shaft 101 for folding the same, the user needs to apply a relatively large force to the central shaft 101 to overcome a biasing action of the opening spring 2. If the user inadvertently lets the umbrella slip from his/her grasp during pushing, the central shaft 101 may extend and the ribs 104 may spread instantly, which may result in damage to the umbrella and injury to the user and people nearby.

SUMMARY OF THE INVENTION

An object of the present invention is to provide a safely operable handle device for an automatic foldable umbrella which can prevent undesirable opening of the umbrella during folding.

According to this invention, the safely operable handle device includes a grip shell which is coupled to a bottom end of a telescopic central shaft unit, a retained block which is releasably blocked by the grip shell for tugging a first force transmission cord so as to hold the umbrella in an opened state, a reel member which is rotatably mounted in the grip shell, a second force transmission cord which is reelable on the reel member and which is coupled to one of a top notch and the retained block, a coil spring which is disposed in the reel member and which can accumulate a restoring force with first and second strengths in response to clockwise and counterclockwise rotations of the reel member, respectively, a push button which is pressible manually to make a stroke movement relative to the grip shell, an actuator which is moved in response to the stroke movement of the push button, and a unidirectional retaining mechanism which is disposed between the actuator and the reel member such that, when a pressing force is applied manually to cause the central shaft unit to displace from an extended position to a folded position, and once the actuator is moved in response to the stroke movement of the push button, the reel member is permitted to be turned in the counterclockwise direction by the second strength of the restoring force of the coil spring, and is prevented from turning in the clockwise direction so as to hold the central shaft unit in position, thereby avoiding undesirable opening of the umbrella, which may cause injury to the user and people nearby.

BRIEF DESCRIPTION OF THE DRAWINGS

Other features and advantages of the present invention will become apparent in the following detailed description of the preferred embodiments of the invention, with reference to the accompanying drawings, in which.

DETAILED DESCRIPTION OF THE PREFERRED EMBODIMENTS

Figure 1:
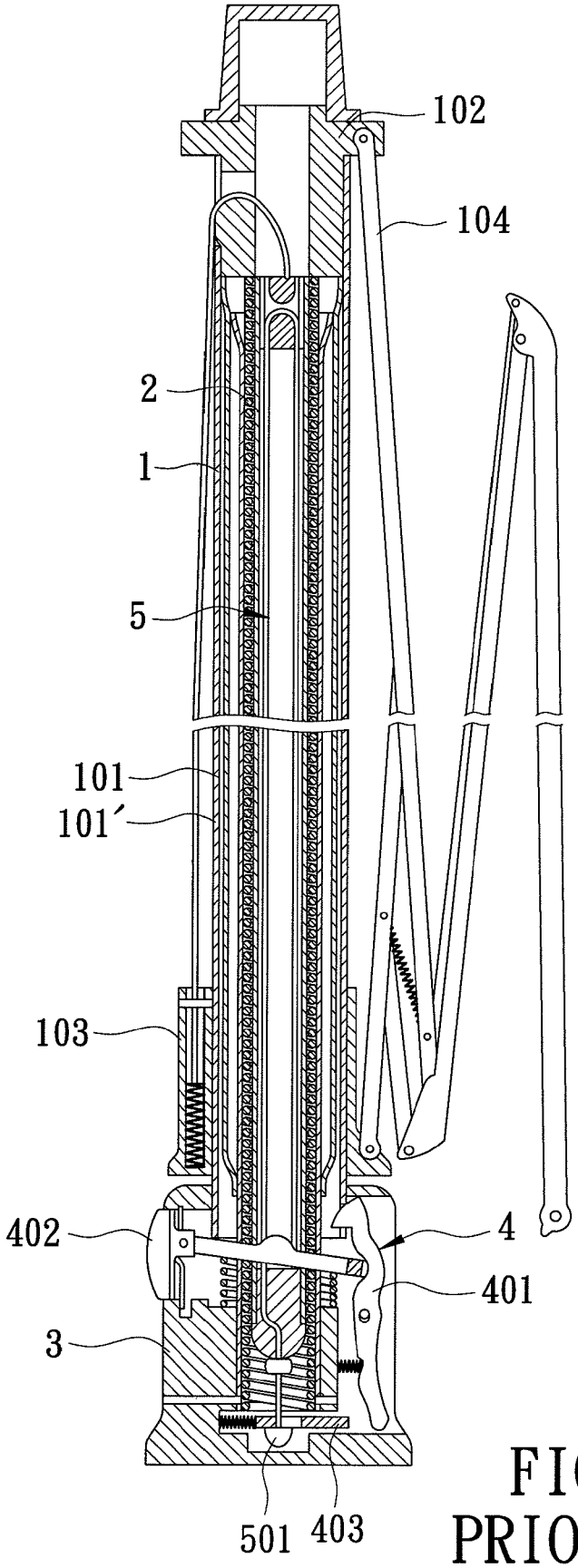
FIG. 1 PRIOR ART
FIG. 1 is a sectional view of a conventional automatic foldable umbrella in a folded state.

Before the present invention is described in greater detail, it should be noted that same reference numerals have been used to denote like elements throughout the specification.

Figure 2:
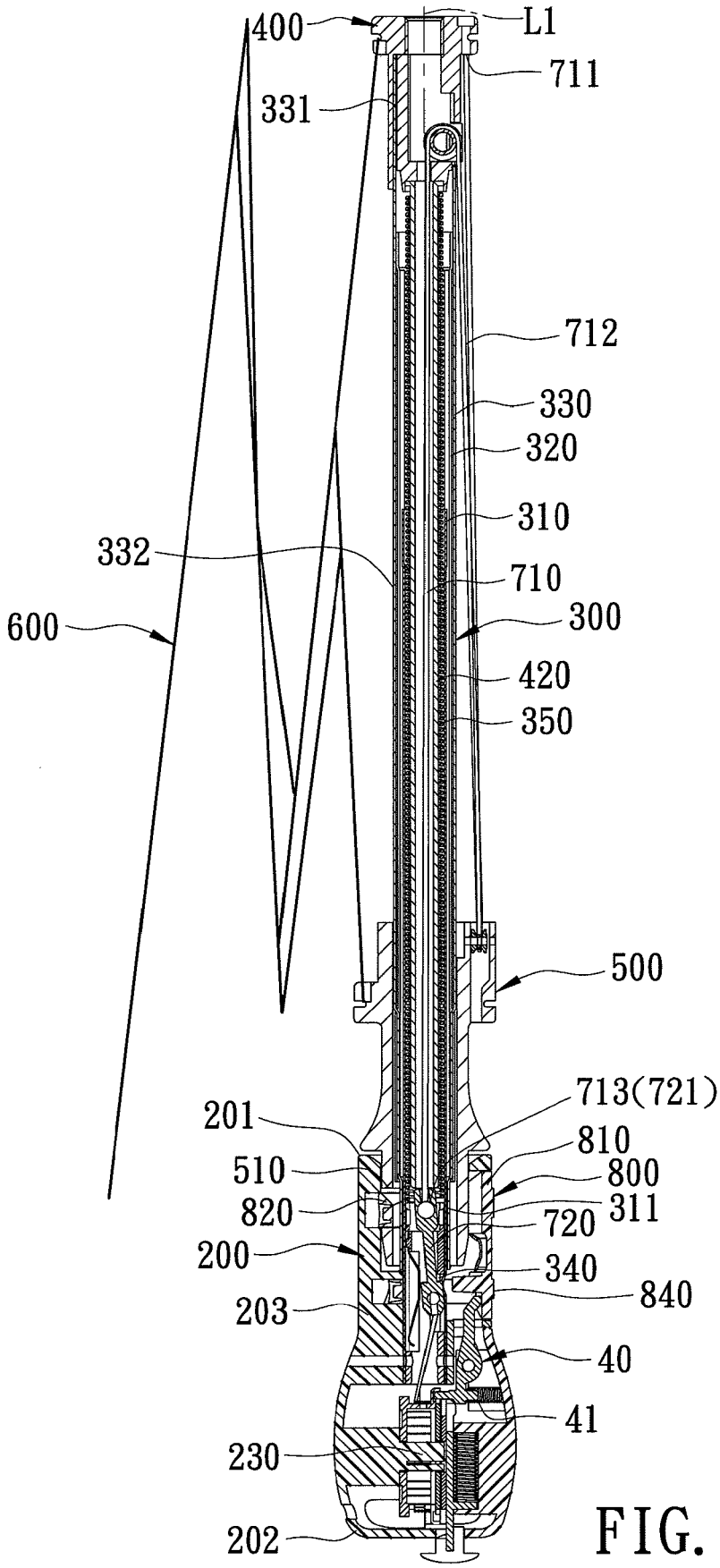
FIG. 2 is a sectional view of the first preferred embodiment of a safely operable handle device according to this invention when incorporated in an automatic foldable umbrella.

Referring to FIG. 2, the preferred embodiment of a safely operable handle device according to the present invention is adapted for use in an automatic foldable umbrella. The umbrella includes a top notch 400 extending along a longitudinal axis (L1) in an axial direction, a central shaft unit 300, a runner 500, a rib-and-stretcher assembly 600, a compression spring 350, and a first force transmission cord 710. The central shaft unit 300 includes upper, middle, and lower tubular shafts 330, 320, 310 telescopically coupled to each other. The upper tubular shaft 330 has a top-side end 331 secured to the top notch 400 to be moved therewith from a folded position (see FIG. 2) to an extended position (see FIGS. 5 and 6), and a runner guiding segment 332 extending from the top-side end 331 in the axial direction. The lower tubular shaft 310 has a bottom end 311 distal from the top notch 400. The runner 500 is slidably sleeved on the runner guiding segment 332. The rib-and-stretcher assembly 600 pivotally interconnects the top notch 400 and the runner 500 so as to be moved from a collapsed position (see FIG. 2) to a spread position (see FIG. 5) when the runner 500 is displaced from a distal position to a proximate position relative to the top notch 400. The compression spring 350 is disposed within the central shaft unit 300. The first force transmission cord 710 has a first coupling end 711 tensely moved with the top notch 400, and a first cord segment 712 which extends from the first coupling end 711 to the runner 500, which is wound on the runner 500, and which further extends upward through the top notch 400 and then downward into the central shaft unit 300 to terminate at a first anchoring end 713, which is kept in a tugged position (see FIG. 2) when the runner 500 is in the proximate position, and which is withdrawn to a released position (see FIG. 6) to permit the runner 500 to be moved to the distal position, thereby bringing the rib-and-stretcher assembly 600 to the collapsed position. A tubular restricting member 420 extends downwardly from the top notch 400 and is disposed in the central shaft unit 300.

Figure 3:
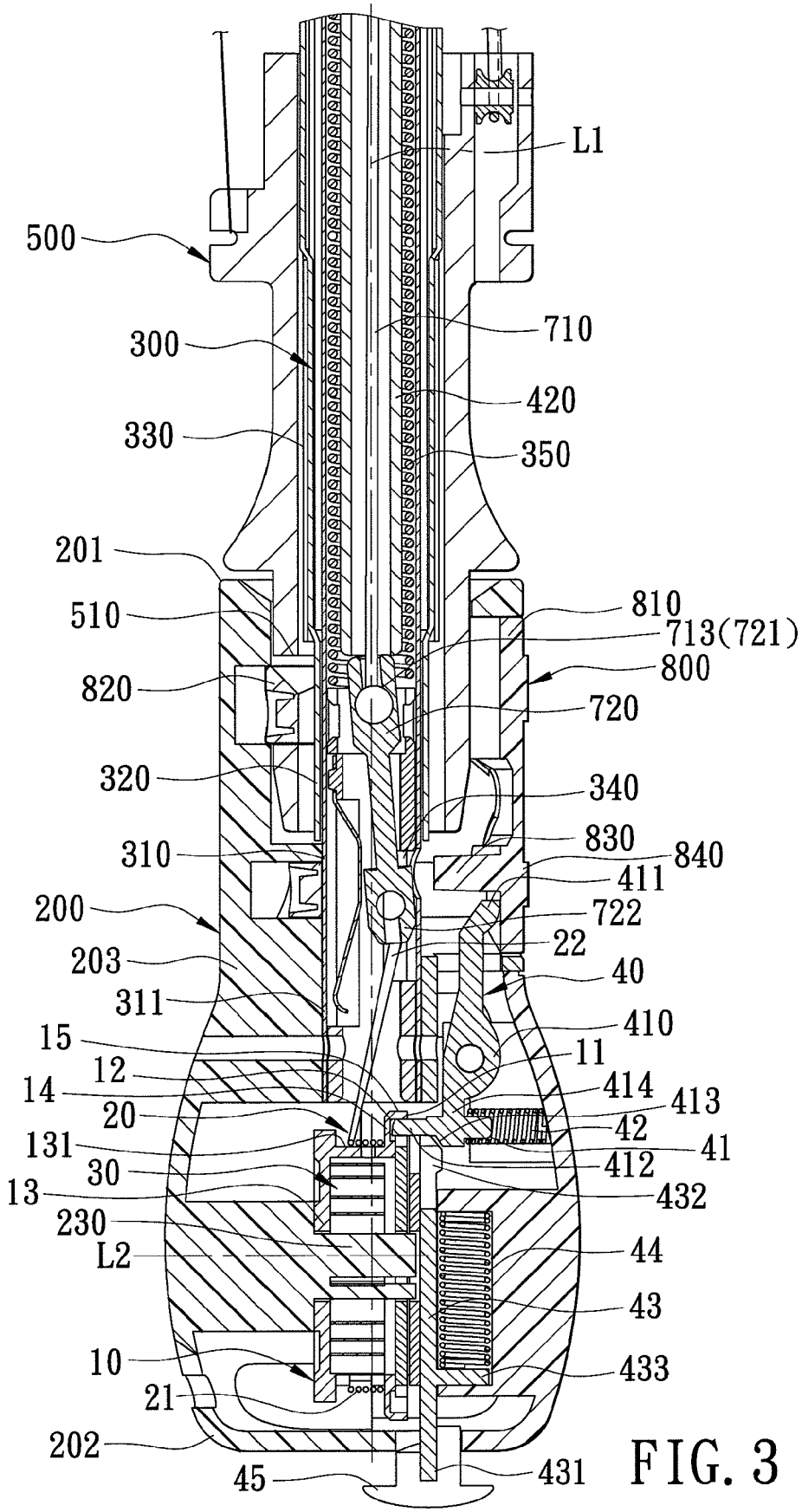
FIG. 3 is an enlarged sectional view of the first preferred embodiment.
Figure 4:
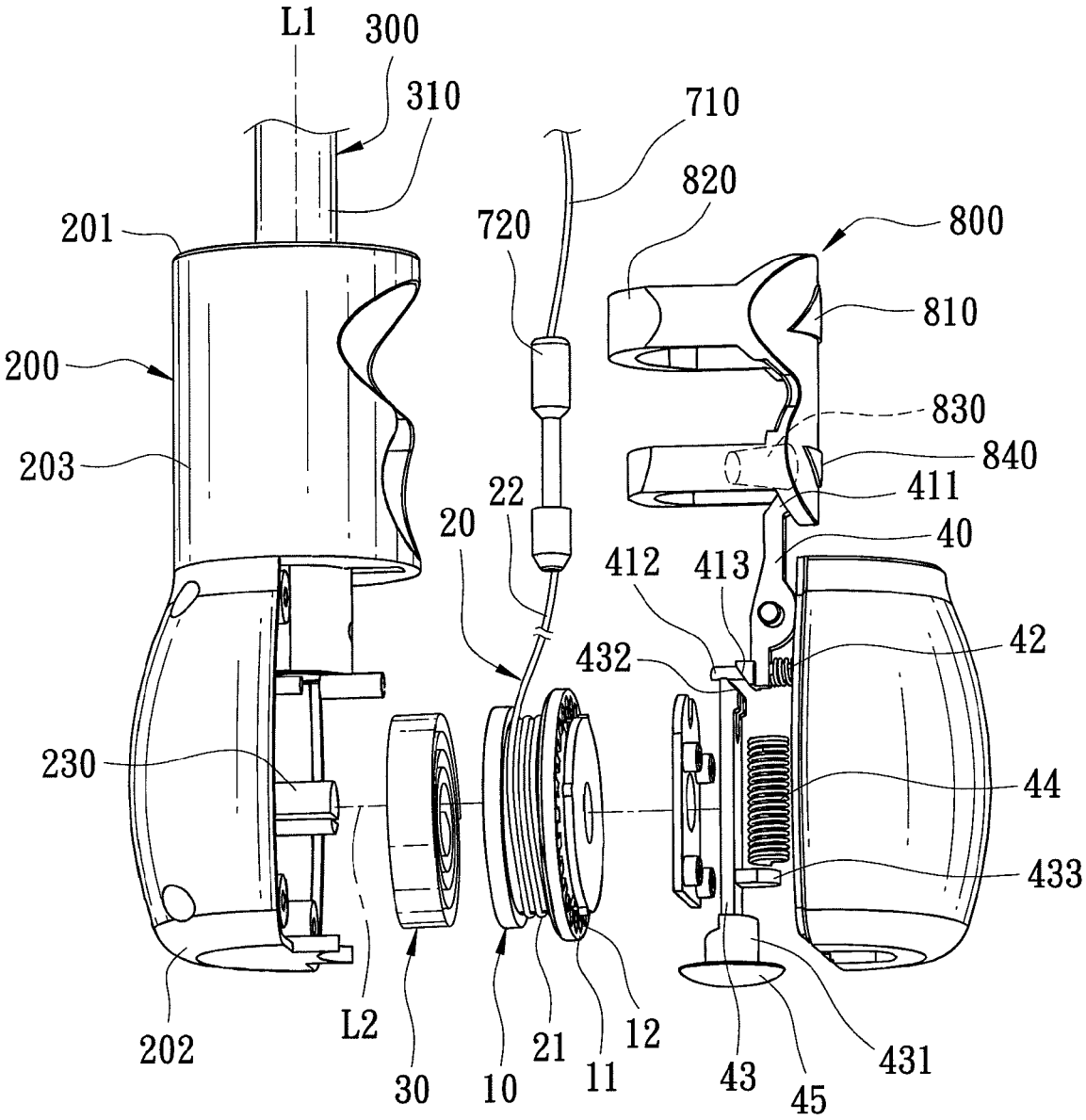
FIG. 4 is an exploded perspective view of the first preferred embodiment.

With reference to FIGS. 2 to 4, the safely operable handle device according to this invention is shown to comprise a grip shell 200, a retained block 720, a reel member 10, a second force transmission cord 20, a coil spring 30, a push button 45, an actuator 43, a unidirectional retaining mechanism, and a press button member 800.

The grip shell 200 includes upper and lower walls 201, 202 spaced apart from each other in the axial direction to define a chamber unit which has upper and lower chambers respectively proximate to the upper and lower walls, and a barrel wall 203 interposed there between to surround the upper and lower chambers. The upper chamber is adapted to accommodate the bottom end 311 of the lower tubular shaft 310.

The retained block 720 has an upper end 721 adapted to be moved with the first anchoring end 713 of the first force transmission cord 710, and a lower end 722. The retained block 720 is moved between a first orientation, where the lower end 722 is blocked in a retaining portion 340 of the lower tubular shaft 310 so as to hold the first anchoring end 713 in the tugged position, and a second orientation, where the lower end 722 is disengaged from the retaining portion 340 to permit the first anchoring end 713 to be withdrawn to the released position.

The reel member 10 is rotatably mounted on an axle 230 on the grip shell 200 in the rear chamber about a reeling axis (L2) that is transverse to the axial direction. The reel member 10 includes a hub body 13 which has an outer hub surface 131 surrounding the reeling axis (L2), and a surrounding flange 14 extending radially and outwardly from a peripheral edge of the hub body 13 to terminate at a rim surface 15, and to form an outer circumferential surface 11 that faces away from the hub body 13.

The second force transmission cord 20 has a second anchoring end 22 which is coupled to and is moved with the lower end 722 of the retained block 720, and a second reelable end 21 which is secured to and is tensely reelable on the outer hub surface 131 such that, as a result of displacement of the first anchoring end 713 from the tugged position to the released position, and reeling-out of the second force transmission cord 20, the second reelable end 21 is brought to make an angular advancement in a clockwise direction.

The coil spring 30 is a volute spring disposed in the reel member 10 and is configured such that the coil spring 30 accumulates a restoring force with a gradually increasing first strength with the angular advancement of the second reelable end 21 in the clockwise direction. The first strength changes into a gradually reduced second strength which biases the reel member 10 to turn about the reeling axis (L2) in a counterclockwise direction.

The push button 45 is mounted on the lower wall 202, and is pressed manually to make a stroke movement relative to the lower wall 202 in the axial direction.

The actuator 43 includes a pressed end 431 configured to be moved in response to the stroke movement of the push button 45 from a first position to a second position, and an actuating end 432 opposite to the pressed end 431.

The unidirectional retaining mechanism includes a plurality of engaging holes 12 which are formed in the outer circumferential surface 11 and which are angularly displaced from one another about the reeling axis (L2), a retaining finger 41 which has a retaining end 412 that is brought to engage or disengage from one of the engaging holes 12 so as to guard against or permit rotation of the reel member 10, and a force-transmitting end 413 which is actuated by the actuating end 432 to cause the retaining end 412 to disengage from one of the engaging holes 12 when the pressed end 431 is displaced from the first position to the second position, a first biasing member 42 which is disposed to bias the force-transmitting end 413 so as to bring the retaining end 412 into engagement with one of the engaging holes 12, and a second biasing member 44 which is disposed to bias a protrusion 433 of the pressed end 431 to the first position. The actuating end 432 and the force-transmitting end 413 respectively have cam surfaces configured to mate with each other such that the stroke movement of the push button 45 in the axial direction results in movement of the retaining finger 41 in a transverse direction parallel to the reeling axis (L2).

In addition, the safely operable handle device according to this embodiment further comprises a lever 40 which includes a fulcrum 410 with a fulcrum axis that is transverse to both the axial direction and the reeling axis (L2), and a power region 411 and a weight end 414 that are at two opposite sides of the fulcrum 410. The weight end 414 is integrally formed with the retaining finger 41 such that pressing of the power region 411 results in turning of the weight end 414 about the fulcrum axis to cause the retaining end 412 to disengage from one of the engaging holes 12.

The press button member 800 includes upper and lower press buttons 810, 840, a retained ring 820 extending transversely from the upper press button 810 and retained in a retaining hole 510 formed in the runner 500 so as to hold the top-side end 331 in the folded position, and a pressing stud 830 extending transversely from the lower press button 840.

Figure 5:
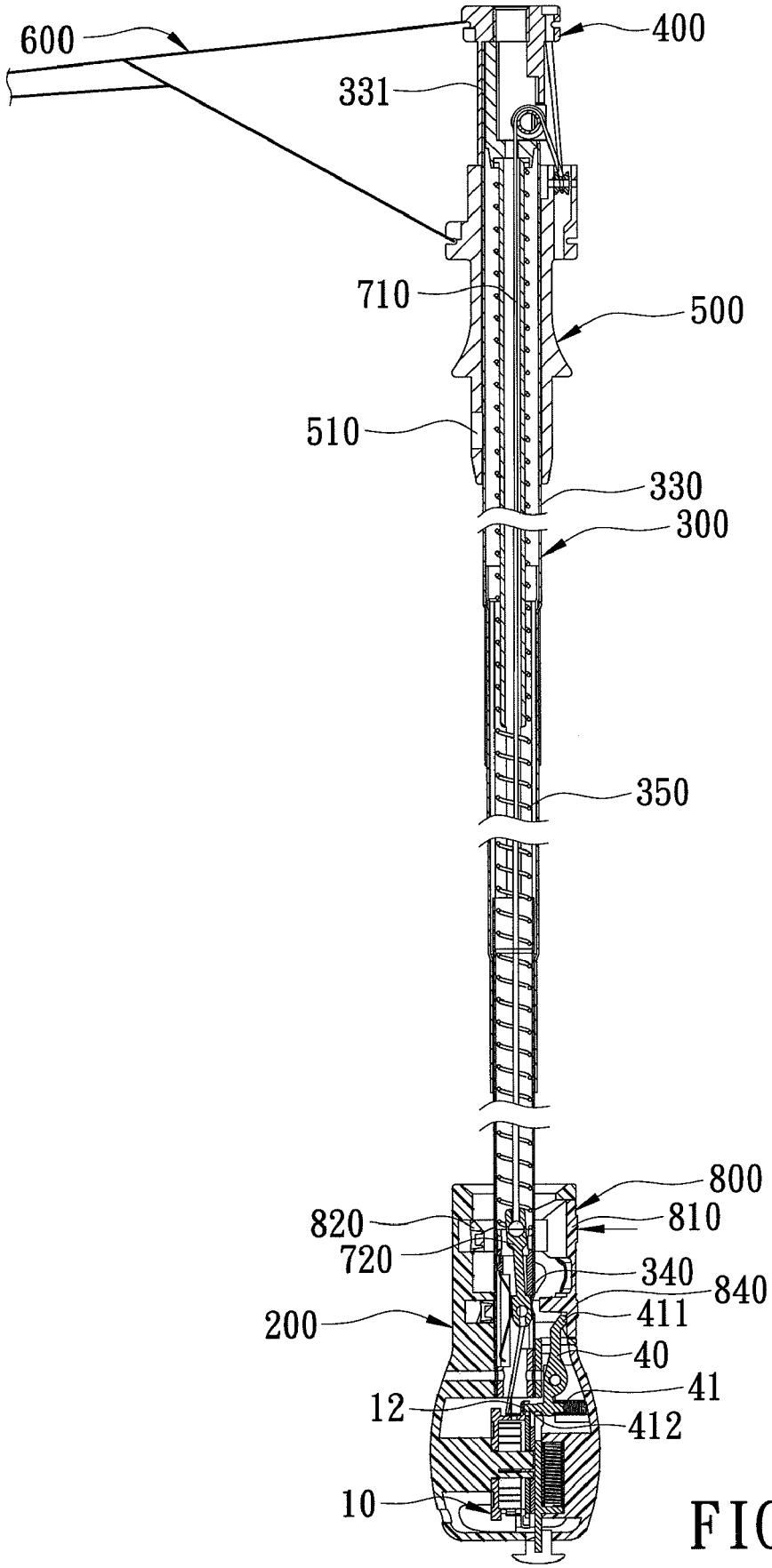
FIG. 5 is a sectional view showing the automatic foldable umbrella incorporating the first preferred embodiment in a stretched state.

As shown in FIGS. 2 and 5, when it is desired to open the umbrella, the upper press button 810 is pressed manually so that the retained ring 820 disengages from the retaining hole 510. The top-side end 331 of the upper tubular shaft 330, together with the topnotch 400, is moved from the folded position to the extended position by virtue of a biasing force of the compression spring 350, and the runner 500 is subsequently forced to move from the distal position to the proximate position, thereby placing the rib-and-stretcher assembly 600 in the spread position. At this stage, the retained block 720 is retained at the retaining portion 340 and holds the first force transmission cord 710 in the tugged position.

Figure 6:
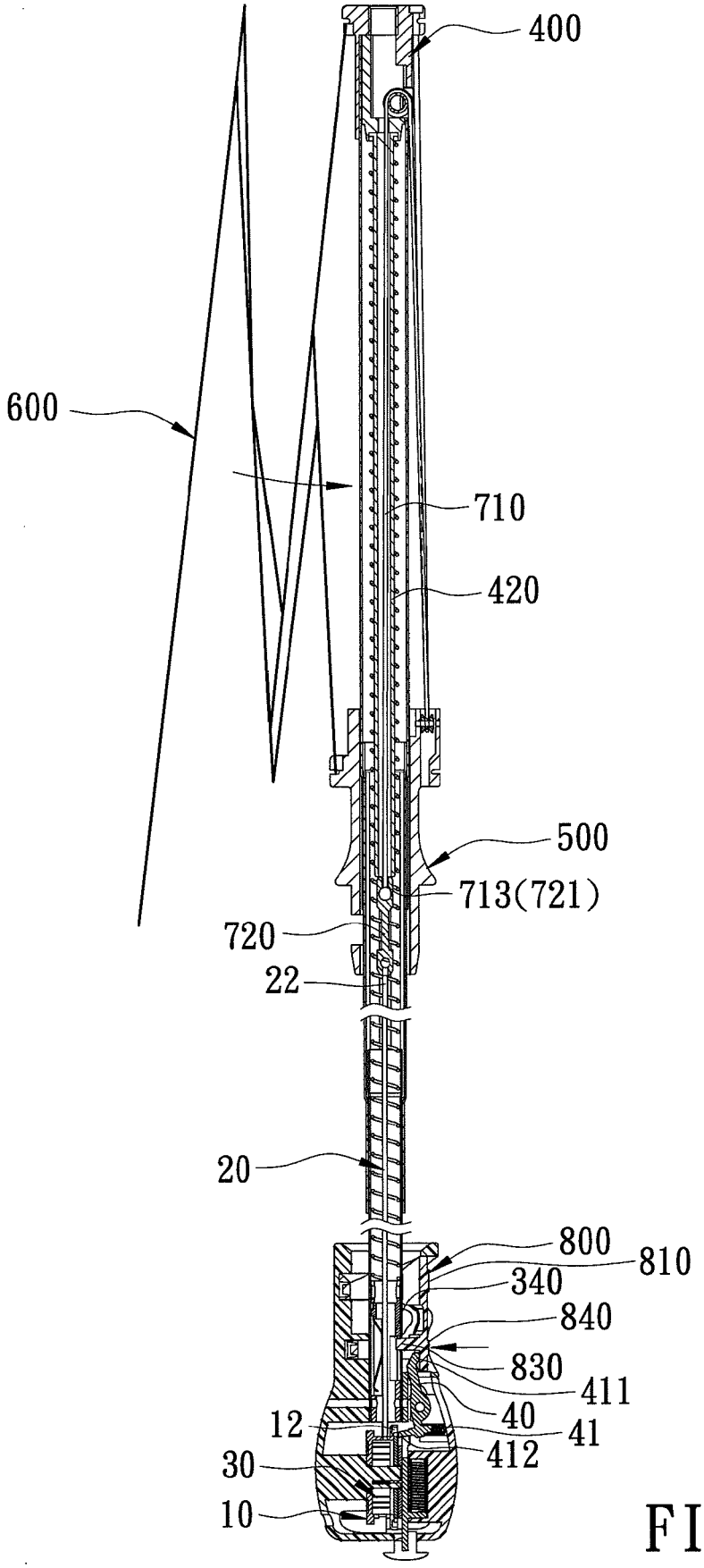
FIG. 6 is a sectional view showing the automatic foldable umbrella incorporating the first preferred embodiment in a collapsed state.

As shown in FIG. 6, when it is desired to close the umbrella, the lower press button 840 is pressed manually so that the pressing stud 830 moves the retained block 720 to cause the retained block 720 to disengage from the retaining portion 340 so as to permit movement of the first force transmission cord 710 to the released position. At the same time, the power region 411 is moved to result in turning of the weight end 414 so as to enable the retaining end 412 to disengage from one of the engaging holes 12. An this stage, the rib-and-stretcher assembly 600 can be collapsed, the runner 500 is moved to the distal position, and the first anchoring end 713 and the retained block 720 are moved upwardly and are restricted by the tubular restricting member 420. At the same time, the reel member 10 is rotated in the clockwise direction by the second strength of the restoring force of the coil spring 30 to reel out the second force transmission cord 20.

Figure 7:
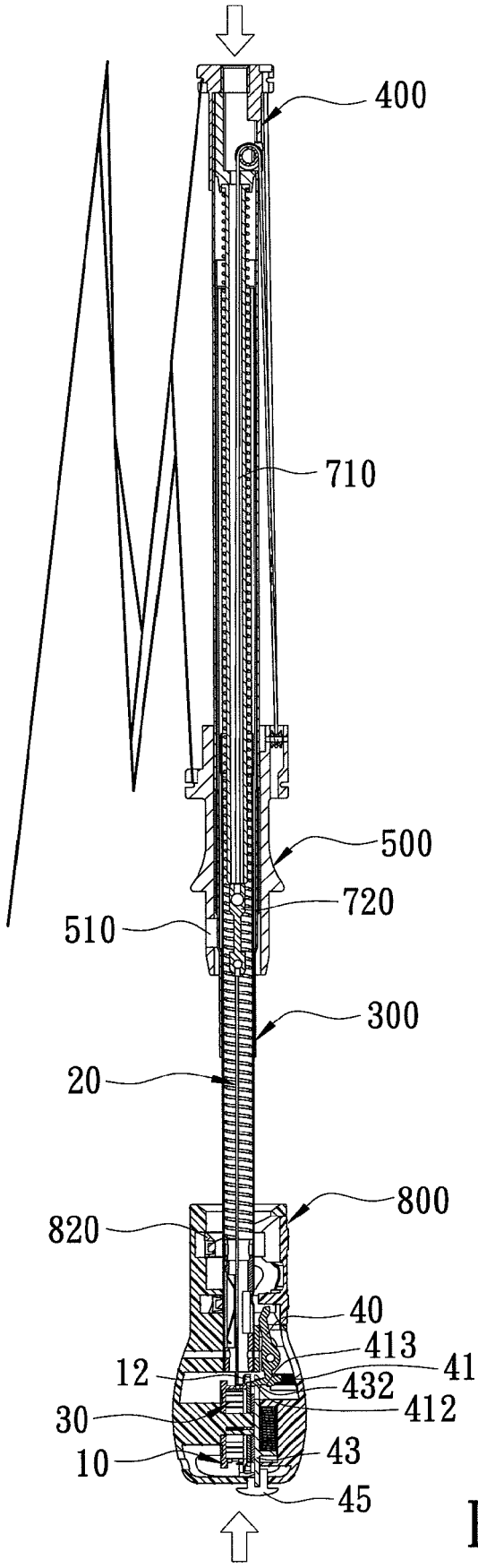
FIG. 7 is a sectional view showing how the automatic foldable umbrella incorporating the first preferred embodiment is folded.

Referring to FIG. 7, when it is desired to fold the umbrella, the push button 45 is pressed manually so that the retaining end 412 disengages from one of the engaging holes 12, and a pressing force is simultaneously applied to the top notch 400 such that the central shaft unit 300 displaces from the extended position to the folded position against the biasing force of the compression spring 350 while the reel member 10 is rotated in the counterclockwise direction by the first strength of the restoring force of the coil spring 30 to reel in the second force transmission cord 20. The umbrella is placed in the folded state as shown in FIG. 2 when the retained ring 820 is retained in the retaining hole 510.

Figure 8:
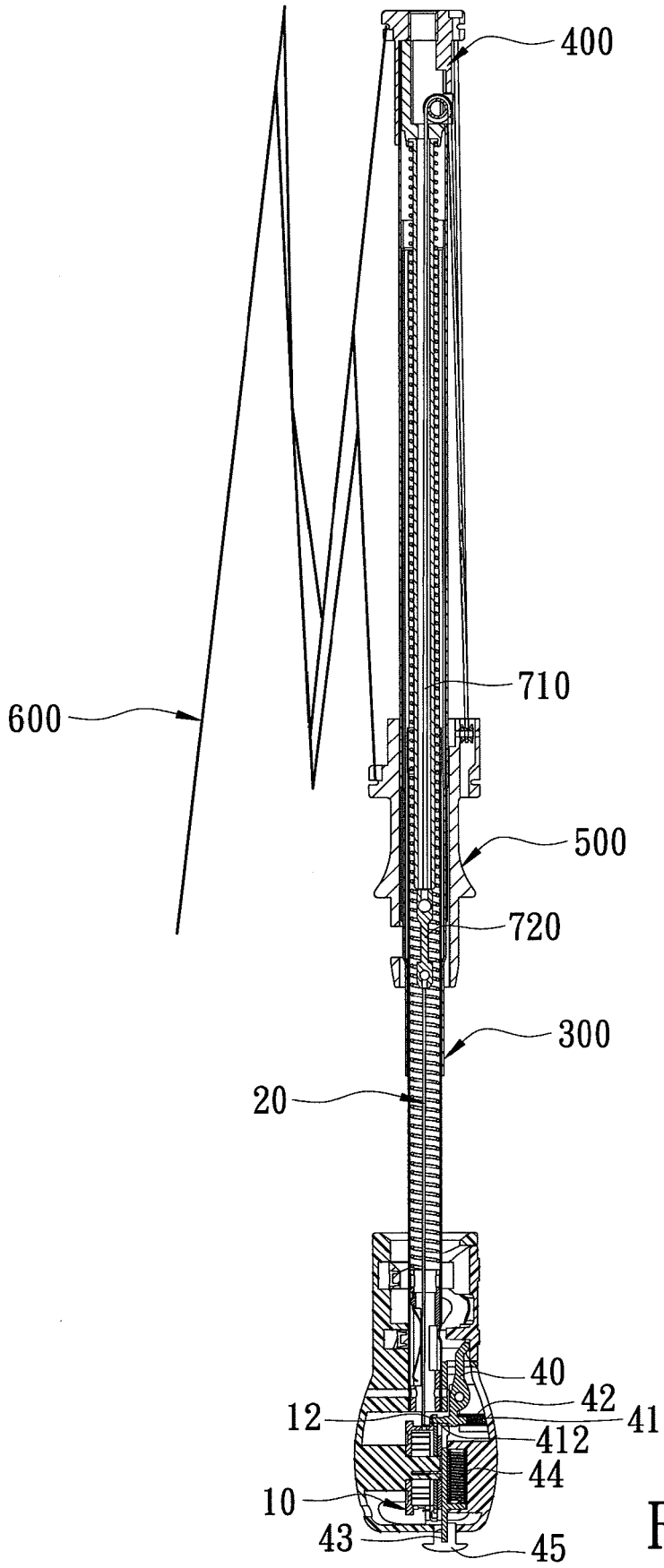
FIG. 8 is a sectional view showing the automatic foldable umbrella incorporating the first preferred embodiment in a state when a pressing force manually applied to a shaft of the umbrella during a folding operation is suddenly removed therefrom.

During folding of the umbrella, if the user inadvertently loses grip of the push button 45 and the top notch 400, as shown in FIG. 8, due to the arrangement of the first and second biasing members 42, 44, the retaining end 412 is engaged with one of the engaging holes 12 to guard against rotation of the reel member 10 so as to restrict movement of the first force transmission cord 710 and the retained block 720, thereby holding the runner 500, the central shaft unit 300, and the rib-and-stretcher assembly 600 in position. Thus, undesirable extension and opening of the umbrella, which may cause injury to the user or people nearby can be avoided.

Figure 9:
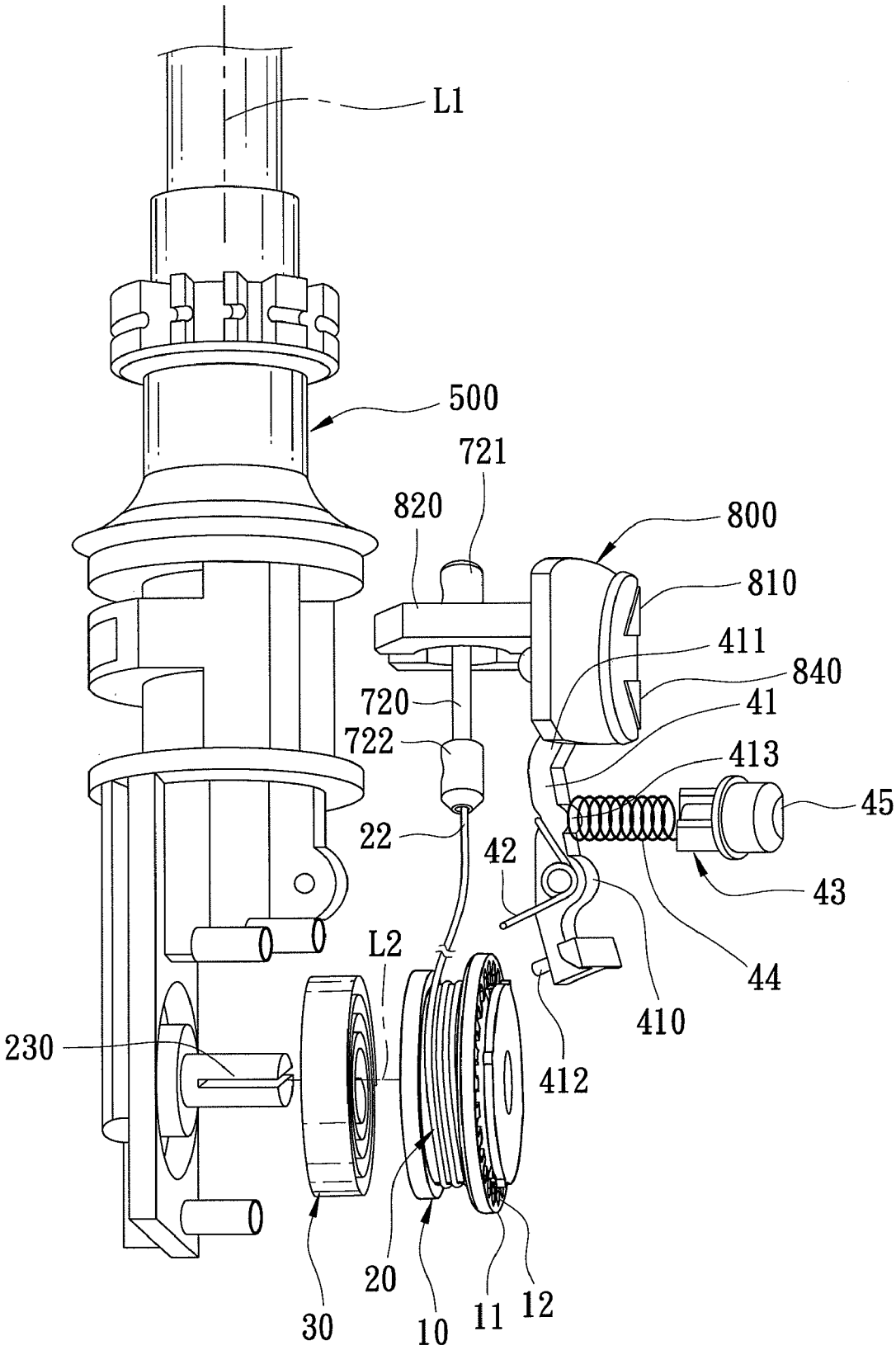
FIG. 9 is an exploded perspective view of the second preferred embodiment of a safely operable handle device according to this invention.
Figure 10:
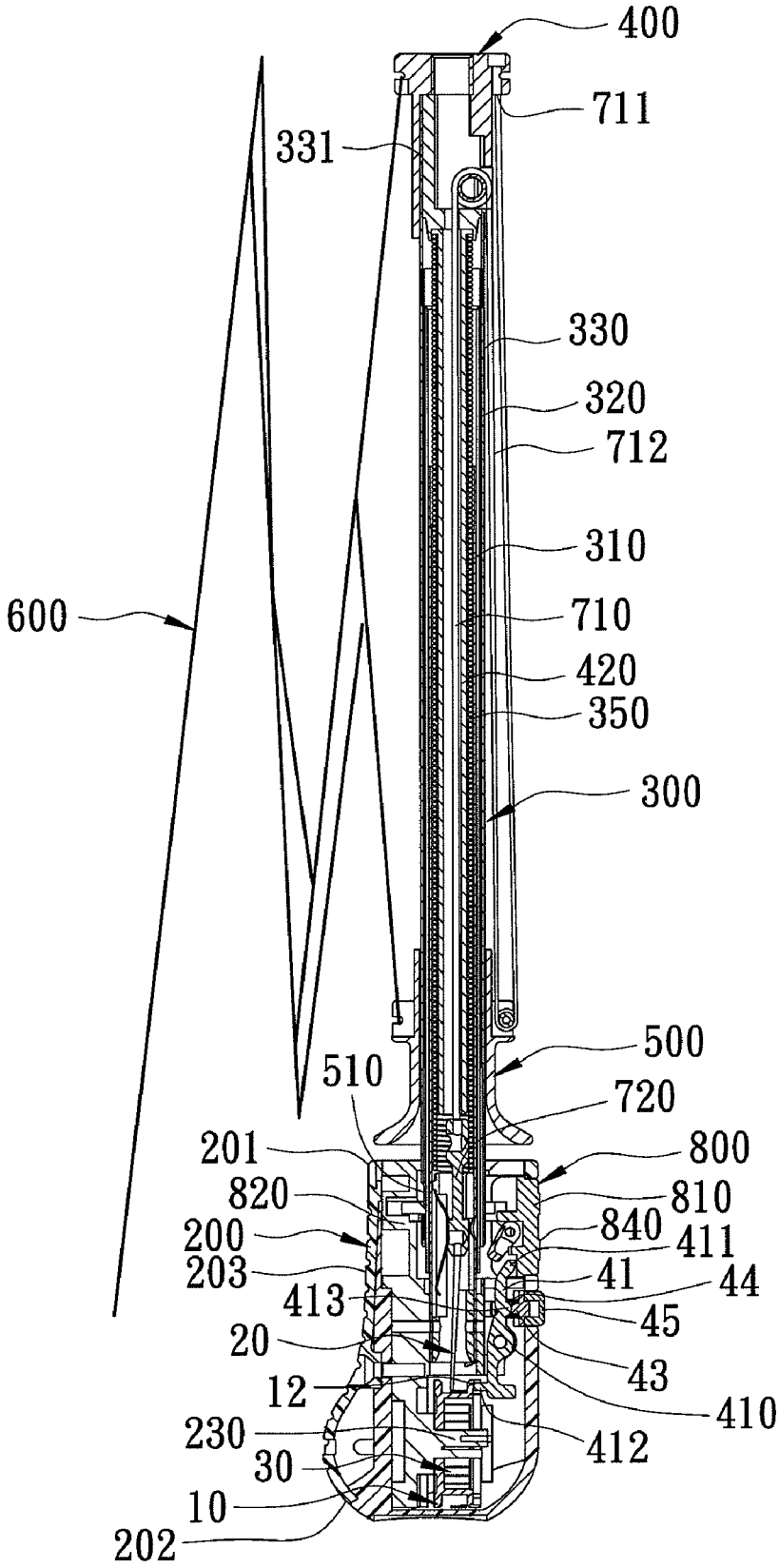
FIG. 10 is a sectional view of the second preferred embodiment when incorporated in an automatic foldable umbrella.

Referring to FIGS. 9 and 10, the second preferred embodiment of a safely operable handle device according to this invention is shown to be similar to the first embodiment in construction. In the second embodiment, the push button 45 is mounted on the barrel wall 203 below the lower press button 840, and is movable relative to the barrel wall 203 in the transverse direction parallel to the reeling axis (L2). Specifically, the retaining finger 41 has a fulcrum 410 which is interposed between the retaining and force-transmitting ends 412, 413, and a power region 411 extending from the force-transmitting end 413 away from the fulcrum 410. Thus, by pressing the force-transmitting end 413 when the lower press button 840 is pressed manually, the retaining end 412 is turned about the fulcrum 410 to disengage from one of the engaging holes 12, and the retained block 720 is moved from the first orientation to the second orientation so as to permit movement of the first force transmission cord 710 to the released position. Moreover, the retaining hole 510 for retaining the retained ring 820 so as to hold the central shaft unit 300 in the folded position is formed in the upper tubular shaft 330 rather than in the runner 500.

Figure 11:
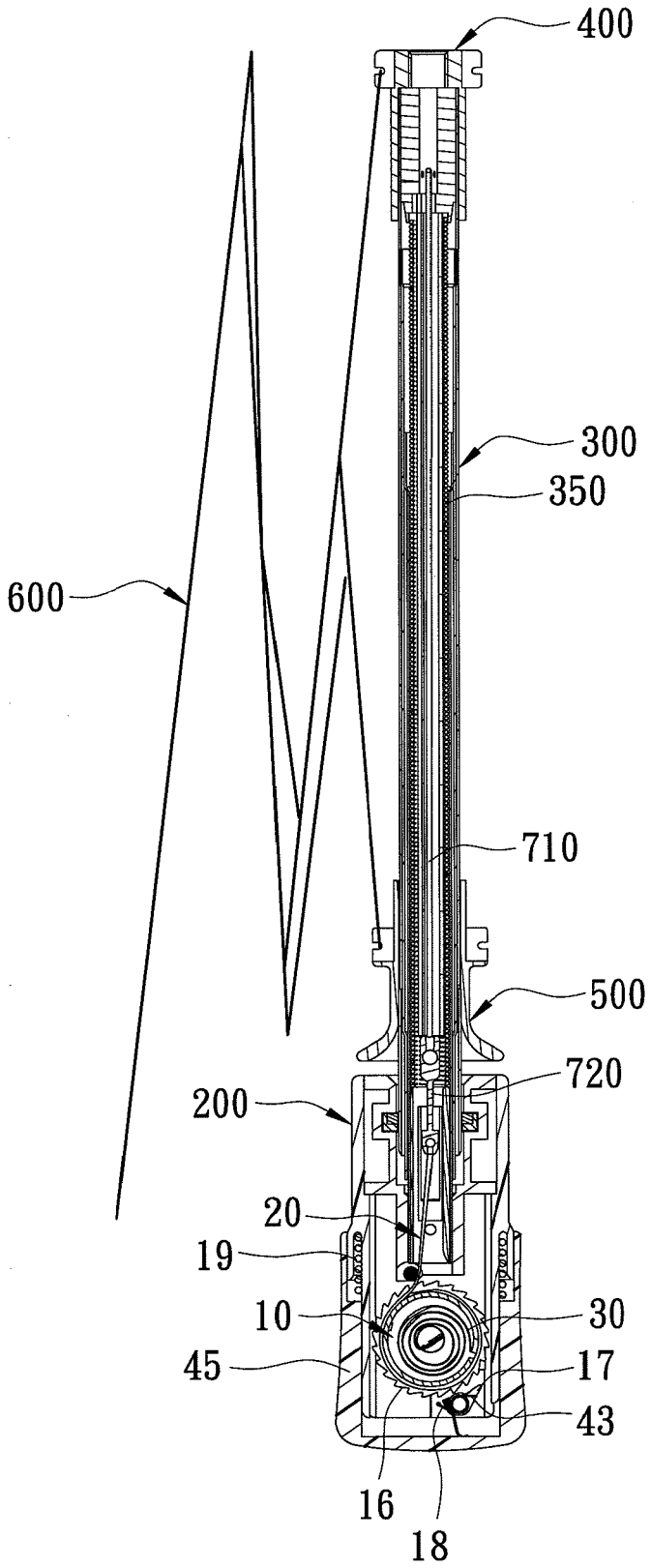
FIG. 11 is a sectional view of the third preferred embodiment of a safely operable handle device according to this invention when incorporated in an automatic foldable umbrella.
Figure 12:
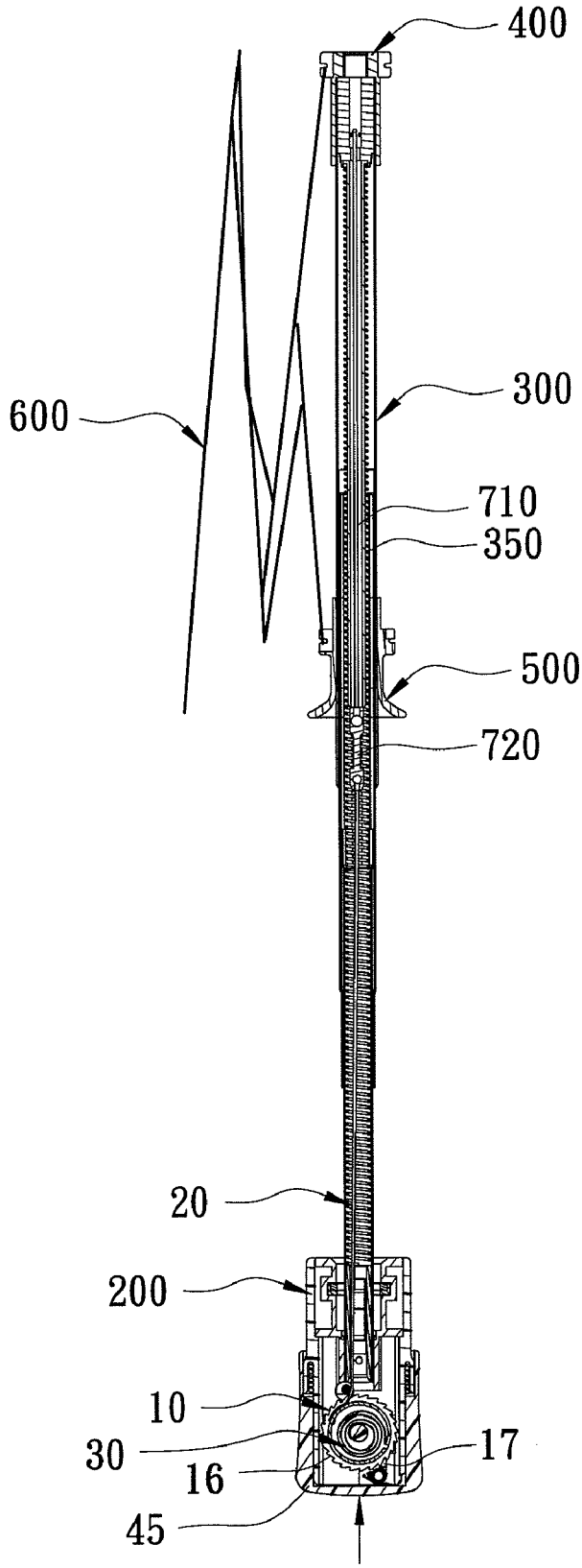
FIG. 12 is a sectional view showing how the automatic foldable umbrella incorporating the third preferred embodiment is folded.
Figure 13:
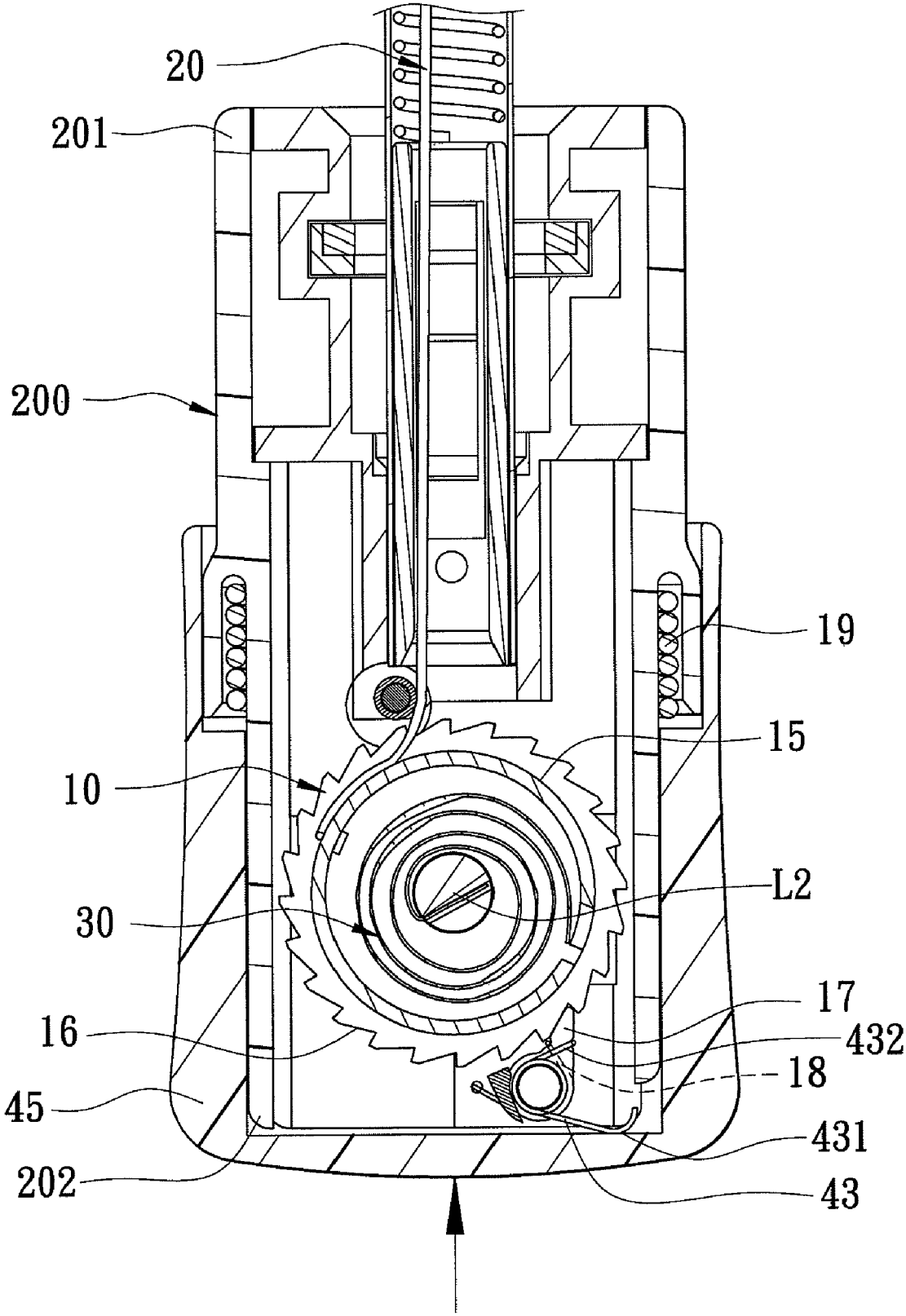
FIG. 13 is an enlarged sectional view of the third preferred embodiment of FIG. 12.
Figure 14:
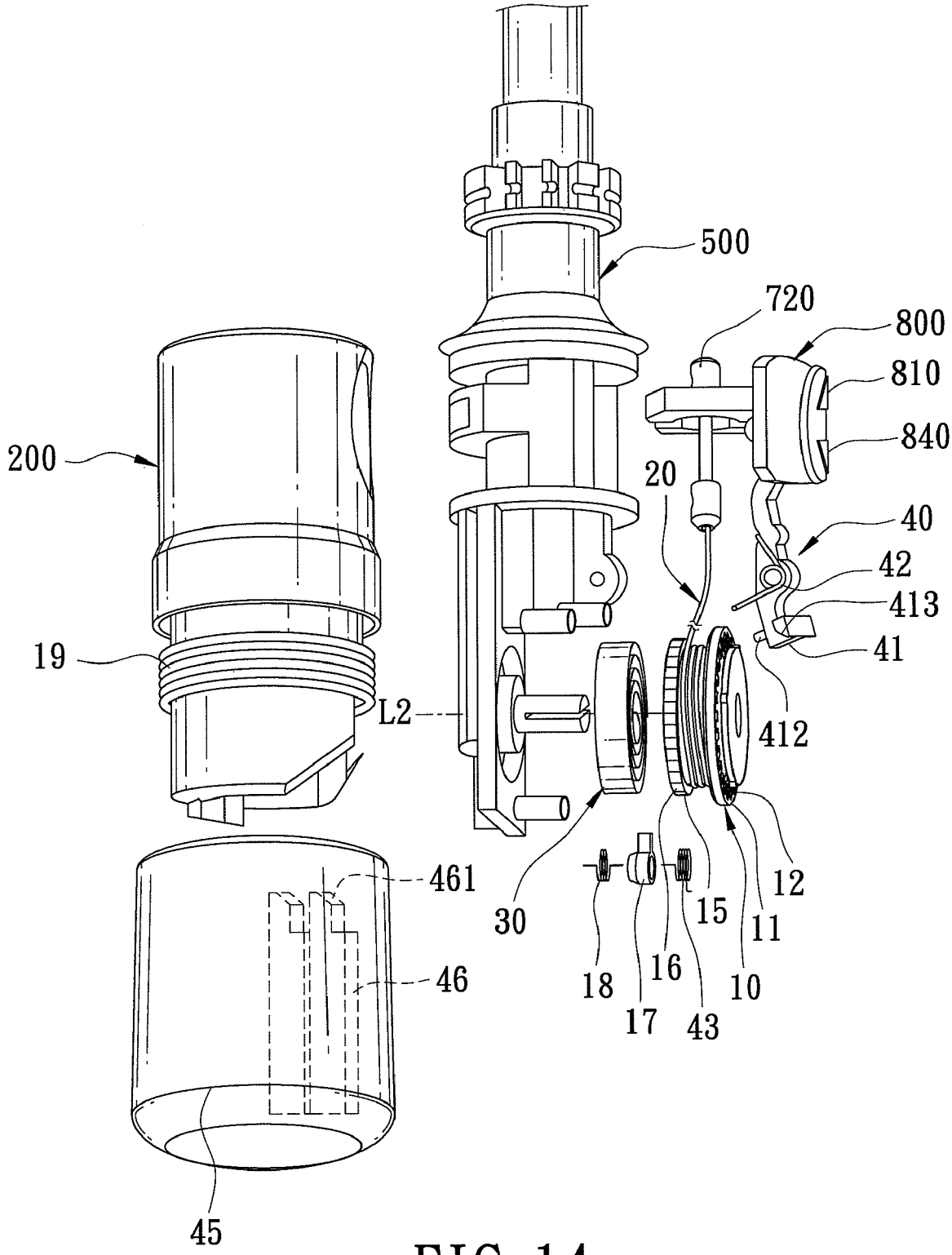
FIG. 14 is an exploded perspective view of the fourth preferred embodiment of a safely operable handle device according to this invention.
Figure 15:
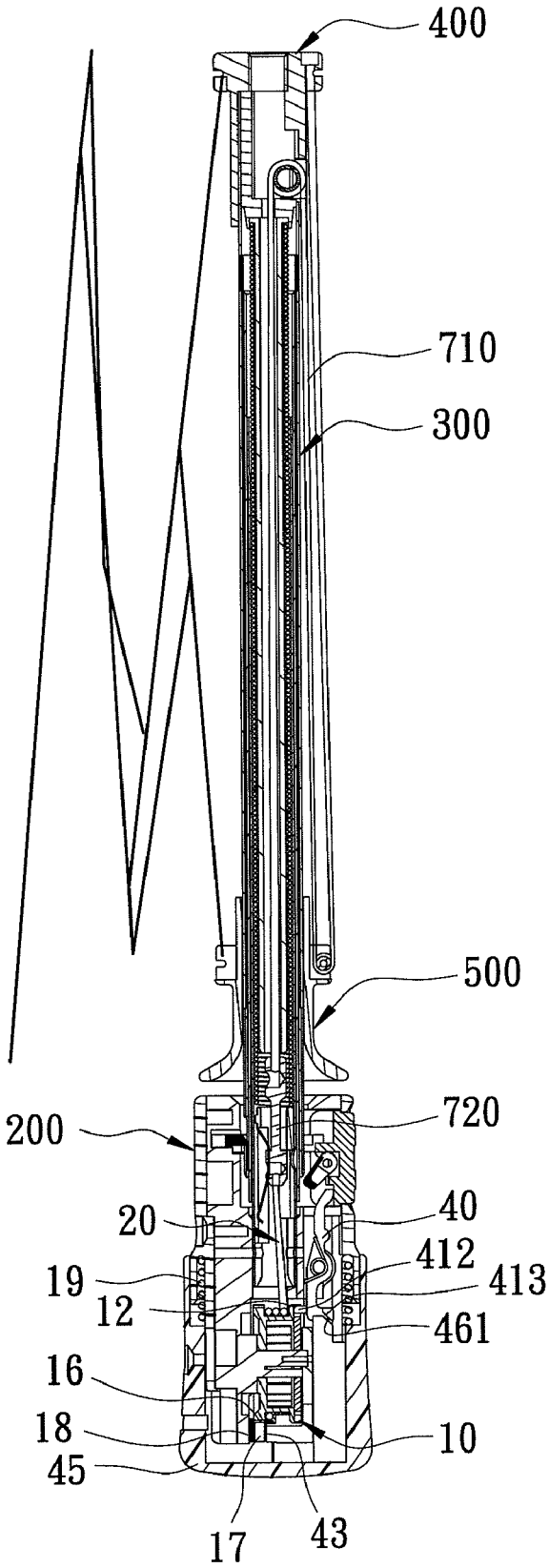
FIG. 15 is a sectional view of the fourth preferred embodiment when incorporated in an automatic foldable umbrella.
Figure 16:
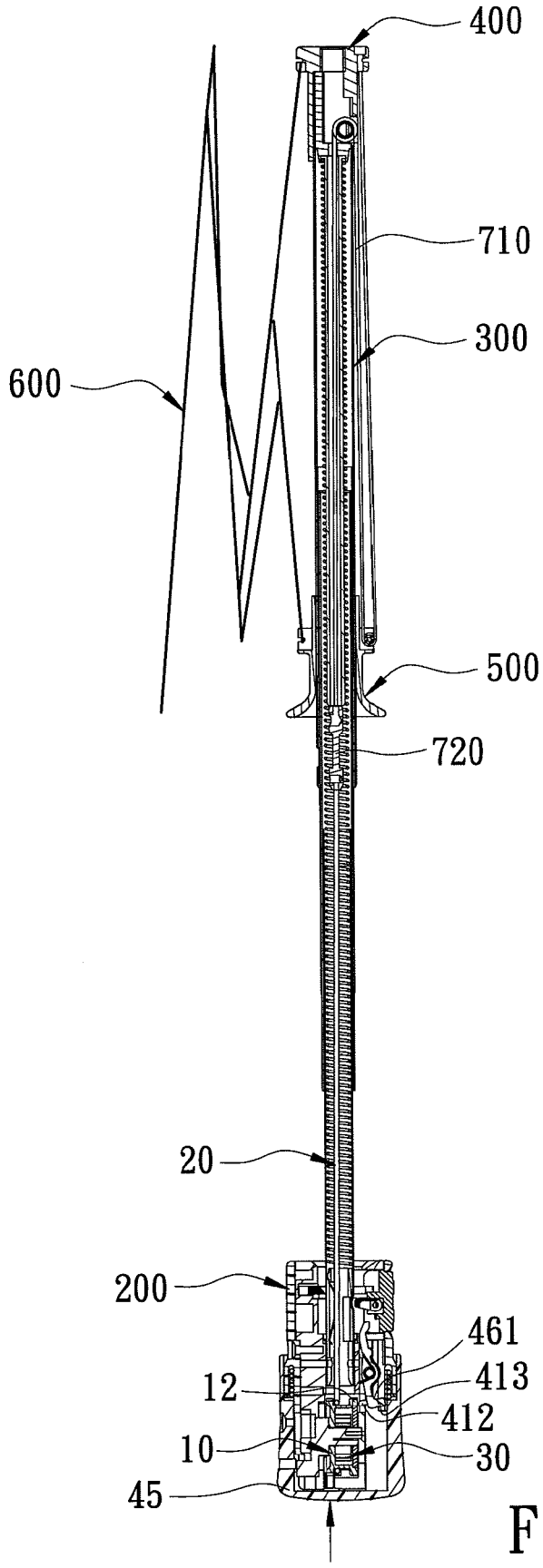
FIG. 16 is a sectional view showing how the automatic foldable umbrella incorporating the fourth preferred embodiment is folded.
Figure 17:
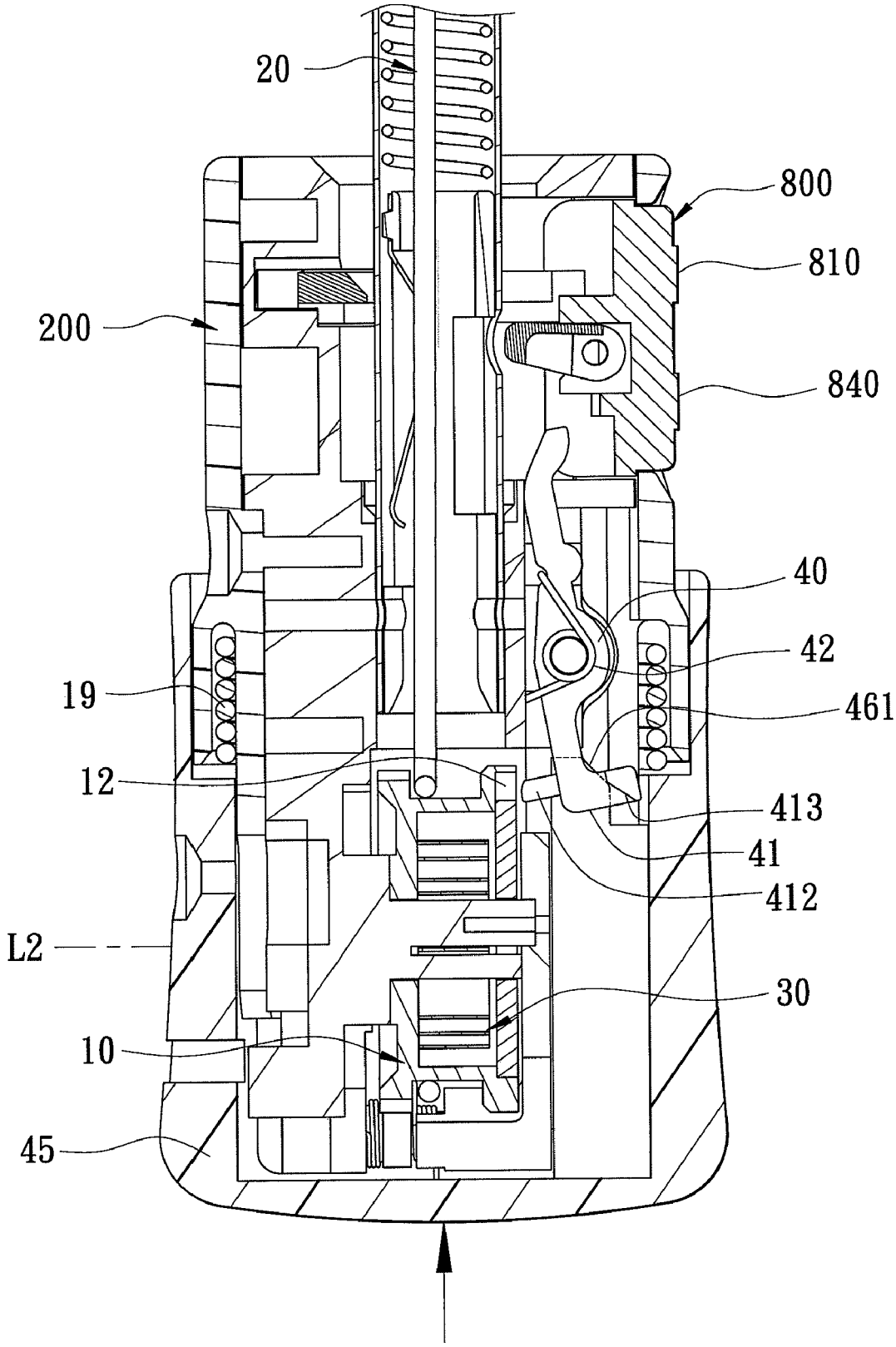
FIG. 17 is an enlarged sectional view of the fourth preferred embodiment.

Referring to FIGS. 11 to 13, the third preferred embodiment of a safely operable handle device according to this invention is shown to be similar to the first embodiment in construction. In the third embodiment, the unidirectional retaining mechanism includes a plurality of ratchet teeth 16 which are formed on the rim surface 15 of the reel member 10, a pawl 17 which is pivotally mounted in the lower chamber about a pivot axis parallel to the reeling axis (L2), and which is urged by an urging force to turn about the pivot axis in the counterclockwise direction so as to engage the ratchet teeth 16, and a first torsion spring 18 which is disposed on the pawl 17 to provide the urging force. In addition, the actuator 43 is in the form of a second torsion spring 43 that has an angularly biasing force which acts in a clockwise direction, and which is greater than the urging force of the first torsion spring 18, and that has the pressed and actuating ends 432, 431, which are respectively proximate to and distal from the push button 45. The push button 45 is disposed on and is movable relative to the lower wall 202 of the grip shell 200 in the axial direction. A coil spring 19 is disposed to bias the push button 45 away from the lower wall 202.

When it is desired to fold the umbrella, the push button 45 is pressed manually to cause the second torsion spring 43 to move angularly about the pivot axis to a non-acting position, where the pressed end 431 is displaced to the second position and where the actuating end 432 is in an idle state, so that the pawl 17 is turned and is engaged with one of the ratchet teeth 16. At the same time, a pressing force is applied manually to the topnotch 400 such that the central shaft unit 300 displaces from the extended position to the folded position while the reel member 10 is rotated in the counterclockwise direction to reel in the second force transmission cord 20. By virtue of the urging force of the first torsion spring 18 which counteracts the second strength of the restoring force of the coil spring 30, the pawls 17 can be kept in slidable engagement with the ratchet teeth 16. If the user inadvertently loses grip of the push button 45 and the top notch 400, due to the engagement between the pawl 17 and one of the ratchet teeth 16, clockwise rotation of the reel member 10 is restricted to prevent reeling out of the second force transmission cord 20, thereby holding the runner 500, the central shaft unit 300, and the rib-and-stretcher assembly 600 in position. Thus, undesirable extension and opening of the umbrella, which may cause injury to the user or people nearby can be avoided.

When the push button 45 is released and is allowed to restore to its original position by means of the coil spring 19, the second torsion spring 43 moves angularly to an acting position, where the pressed end 431 is displaced to the first position, and where the actuating end 432 biases the pawl 17 to cause the pawl 17 to move in the clockwise direction against the urging force of the first torsion spring 18 such that the pawl 17 is disengaged from the ratchet teeth 16 while being slidably engaged with the push button 45.

Referring to FIGS. 14 to 17, the fourth preferred embodiment of a safely operable handle device according to this invention is shown to be similar to the third embodiment in construction. In the fourth embodiment, the unidirectional retaining mechanism further includes a plurality of engaging holes 12 which are formed in the outer circumferential surface 11 and which are angularly displaced from one another about the reeling axis (L2), a retaining finger 41 which has a retaining end 412 that is brought to engage or disengage from one of the engaging holes 12 so as to guard against or permit rotation of the reel member 10, and a force-transmitting end 413, and an actuating member 46 which is disposed on the push button 45. The retaining end 412 and an actuating end 461 of the actuating member 46 have cam surfaces mating with each other such that, when the push button 45 is pressed manually to move the pressed end 431 from the first position to the second position, the retaining end 412 is moved and is disengaged from one of the engaging holes 12. The unidirectional retaining mechanism further includes a lever 40 and a biasing member 42 which are similar to those in the first or second embodiment.

Figure 18:
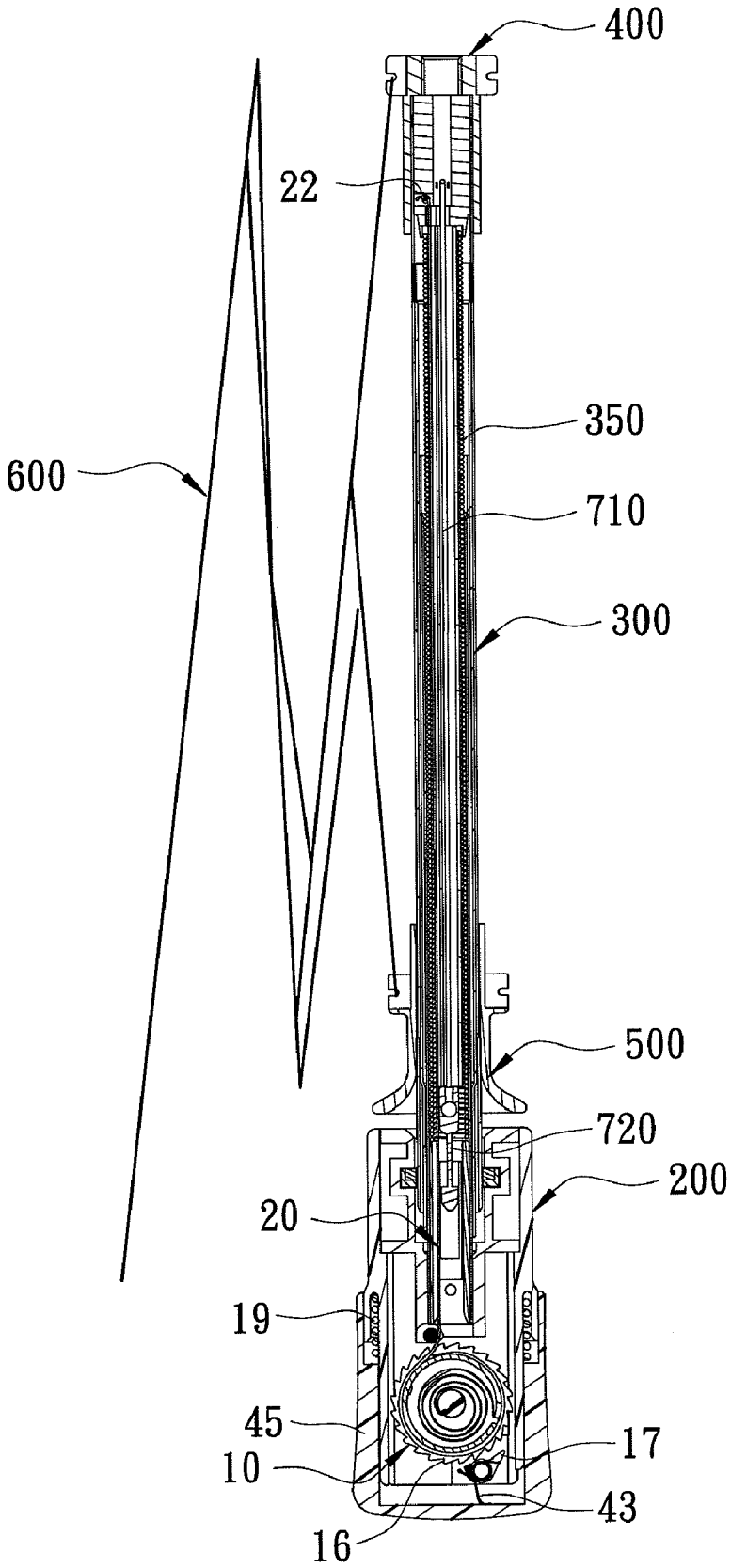
FIG. 18 is a sectional view of the fifth preferred embodiment according to this invention when incorporated in an automatic foldable umbrella.

Referring to FIG. 18, the fifth preferred embodiment of a safely operable handle device according to this invention is shown to be similar to the fourth embodiment in construction, except that the second anchoring end 22 of the second force transmission cord 20 is coupled to the top notch 400 rather than to the retained block 720.

While the present invention has been described in connection with what are considered the most practical and preferred embodiments, it is understood that this invention is not limited to the disclosed embodiments but is intended to cover various arrangements included within the spirit and scope of the broadest interpretations and equivalent arrangements.

I claim:

1. A safely operable handle device for an automatic foldable umbrella, the umbrella comprising:

a top notch extending in an axial direction;

a central shaft unit including upper and lower tubular shafts telescopically coupled to each other, the upper tubular shaft having a top-side end secured to the top notch to be moved therewith from a folded position to an extended position, and a runner guiding segment extending from the top-side end in the axial direction, the lower tubular shaft having a bottom end which is distal from the top notch in the axial direction;

a runner which is slidably sleeved on the runner guiding segment;

a rib-and-stretcher assembly pivotally interconnecting the top notch and the runner so as to be moved from a collapsed position to a spread position when the runner is displaced from a distal position to a proximate position relative to the top notch;

a compression spring which is disposed within the central shaft unit such that, by virtue of a biasing force of the compression spring, the top-side end, together with the top notch, is moved from the folded position to the extended position, and such that the runner is subsequently forced to move from the distal position to the proximate position, thereby placing the rib-and-stretcher assembly in the spread position; and a first force transmission cord having a first coupling end tensely moved with the top notch, and having a first cord segment which extends from the first coupling end to the runner, which is wound on the runner, and which further extends upward through the top notch and then downward into the central shaft unit to terminate at a first anchoring end, which is kept in a tugged position when the runner is in the proximate position, and which is withdrawn to a released position to permit the runner to be moved to the distal position, thereby bringing the rib-and-stretcher assembly to the collapsed position, said safely operable handle device comprising:

a grip shell which includes upper and lower walls that are spaced apart from each other in the axial direction to define a chamber unit having upper and lower chambers that are proximate to and distal from said upper and lower walls, respectively, and a barrel wall that is interposed between said upper and lower walls, and that surrounds said upper and lower chambers, said upper chamber being adapted to accommodate the bottom end;

a retained block which has a lower end, and an upper end adapted to be moved with the first anchoring end such that said retained block is moved between a first orientation, where said retained block is blocked so as to hold the first anchoring end in the tugged position, and a second orientation, where said retained block is movable to permit the first anchoring end to be withdrawn to the released position;

a reel member which is rotatably mounted on said grip shell in said rear chamber about a reeling axis, said reel member including a hub body having an outer hub surface which surrounds the reeling axis, and which has a peripheral edge, and a surrounding flange which is configured to extend radially from said peripheral edge to terminate at a rim surface, and to form an outer circumferential surface that faces away from said hub body;

a second force transmission cord having a second anchoring end which is coupled and is moved with one of the top notch and said lower end, and a second reelable end which is secured to and is tensely reelable on said outer hub surface such that displacement of the first anchoring end from the tugged position to the released position and reeling-out of said second force transmission cord result in angular advancement of said second reelable end in a clockwise direction;

a coil spring disposed in said reel member, said coil spring being configured such that said coil spring accumulates a restoring force with a gradually increasing first strength with the angular advancement of said second reelable end in the clockwise direction, the first strength changing into a gradually reduced second strength which biases said reel member to turn about the reeling axis in a counterclockwise direction;

a push button which is pressable manually to make a stroke movement relative to said grip shell;

an actuator which includes a pressed end configured to move in response to the stroke movement of said push button from a first position to a second position, and an actuating end which is opposite to said pressed end; and a unidirectional retaining mechanism disposed between said actuating end and one said rim surface and said outer circumferential surface such that, when a pressing force is applied manually to cause displacement of the central shaft unit from the extended position to the folded position against the biasing force of the compression spring, and once said pressed end is displaced from the first position to the second position, said reel member is permitted to be turned in the counterclockwise direction by the second strength of the restoring force of said coil spring;

wherein said unidirectional retaining mechanism includes a plurality of ratchet teeth which are formed on said rim surface, a pawl which is pivotally mounted in said lower chamber about a pivot axis parallel to the reeling axis, and which is urged by an urging force to turn about the pivot axis in a counterclockwise direction so as to be engaged with said ratchet teeth such that, when said reel member is permitted to be turned by the second strength of the restoring force in the counterclockwise direction, by virtue of the urging force that counteracts the second strength of the restoring force, said pawl is kept in slidable engagement with said ratchet teeth, and a first torsion spring disposed to provide the urging force to turn said pawl to move about the pivot axis in the counterclockwise direction when said pressed end is in the second position;

said actuator being in the form of a second torsion spring that has an angularly biasing force which biases in a clockwise direction, and which is greater than the urging force of said first torsion spring, and that has said pressed and actuating ends, which are respectively proximate to and distal from said push button, said second torsion spring being movable angularly about the pivot axis between an acting position, where said actuating end biases said pawl to move in the clockwise direction by counteracting the urging force of said first torsion spring so as to disengage said pawl from said ratchet teeth when said pressed end is displaced to the first position, and a non-acting position, where said pressed end is displaced to the second position while said actuating end is in an idle state.

2. The safely operable handle device according to claim 1, wherein said push button is disposed on said lower wall and is movable relative to said lower wall in the axial direction, said safely operable handle device further comprising a coil spring which is disposed to bias said push button away from said lower wall.

3. The safely operable handle device according to claim 1, wherein said unidirectional retaining mechanism further includes a plurality of engaging holes which are formed in said outer circumferential surface and which are angularly displaced from one another about the reeling axis, a retaining finger which has a retaining end that is brought to engage or disengage from one of said engaging holes so as to guard against or permit rotation of said reel member, and a force-transmitting end, and an actuating member which is disposed on said push button and which has an actuating end that is disposed to move said retaining end so as to enable said retaining end to disengage from one of said engaging holes when said pressed end is displaced from the first position to the second position.

4. A safely operable handle device for an automatic foldable umbrella, the umbrella comprising:

a top notch extending in an axial direction;

a central shaft unit including upper and lower tubular shafts telescopically coupled to each other, the upper tubular shaft having a top-side end secured to the top notch to be moved therewith from a folded position to an extended position, and a runner guiding segment extending from the top-side end in the axial direction, the lower tubular shaft having a bottom end which is distal from the top notch in the axial direction;

a runner which is slidably sleeved on the runner guiding segment;

a rib-and-stretcher assembly pivotally interconnecting the top notch and the runner so as to be moved from a collapsed position to a spread position when the runner is displaced from a distal position to a proximate position relative to the top notch;

a compression spring which is disposed within the central shaft unit such that, by virtue of a biasing force of the compression spring, the top-side end, together with the top notch, is moved from the folded position to the extended position, and such that the runner is subsequently forced to move from the distal position to the proximate position, thereby placing the rib-and-stretcher assembly in the spread position; and a first force transmission cord having a first coupling end tensely moved with the top notch, and having a first cord segment which extends from the first coupling end to the runner, which is wound on the runner, and which further extends upward through the top notch and then downward into the central shaft unit to terminate at a first anchoring end, which is kept in a tugged position when the runner is in the proximate position, and which is withdrawn to a released position to permit the runner to be moved to the distal position, thereby bringing the rib-and-stretcher assembly to the collapsed position, said safely operable handle device comprising:

a grip shell which includes upper and lower walls that are spaced apart from each other in the axial direction to define a chamber unit having upper and lower chambers that are proximate to and distal from said upper and lower walls, respectively, and a barrel wall that is interposed between said upper and lower walls, and that surrounds said upper and lower chambers, said upper chamber being adapted to accommodate the bottom end;

a retained block which has a lower end, and an upper end adapted to be moved with the first anchoring end such that said retained block is moved between a first orientation, where said retained block is blocked so as to hold the first anchoring end in the tugged position, and a second orientation, where said retained block is movable to permit the first anchoring end to be withdrawn to the released position;

a reel member which is rotatably mounted on said grip shell in said rear chamber about a reeling axis, said reel member including a hub body having an outer hub surface which surrounds the reeling axis, and which has a peripheral edge, and a surrounding flange which is configured to extend radially from said peripheral edge to terminate at a rim surface, and to form an outer circumferential surface that faces away from said hub body;

a second force transmission cord having a second anchoring end which is coupled and is moved with one of the top notch and said lower end, and a second reelable end which is secured to and is tensely reelable on said outer hub surface such that displacement of the first anchoring end from the tugged position to the released position and reeling-out of said second force transmission cord result in angular advancement of said second reelable end in a clockwise direction;

a coil spring disposed in said reel member, said coil spring being configured such that said coil spring accumulates a restoring force with a gradually increasing first strength with the angular advancement of said second reelable end in the clockwise direction, the first strength changing into a gradually reduced second strength which biases said reel member to turn about the reeling axis in a counterclockwise direction;

a push button which is pressable manually to make a stroke movement relative to said grip shell;

an actuator which includes a pressed end configured to move in response to the stroke movement of said push button from a first position to a second position, and an actuating end which is opposite to said pressed end; and a unidirectional retaining mechanism disposed between said actuating end and one said rim surface and said outer circumferential surface such that, when a pressing force is applied manually to cause displacement of the central shaft unit from the extended position to the folded position against the biasing force of the compression spring, and once said pressed end is displaced from the first position to the second position, said reel member is permitted to be turned in the counterclockwise direction by the second strength of the restoring force of said coil spring; and further comprising an upper press button which is pressable manually to permit movement of said upper tubular shaft from the folded position to the extended position by the biasing force of the compression spring.

5. The safely operable handle device according to claim 4, wherein said unidirectional retaining mechanism includes a plurality of engaging holes which are formed in said outer circumferential surface and which are angularly displaced from one another about the reeling axis, a retaining finger which has a retaining end that is brought to engage or disengage from one of said engaging holes so as to guard against or permit rotation of said reel member, and a force-transmitting end which is actuated by said actuating end to cause said retaining end to disengage from one of said engaging holes when said pressed end is displaced from the first position to the second position, a first biasing member which is disposed to bias said force-transmitting end so as to bring said retaining end into engagement with one of said engaging holes, and a second biasing member which is disposed to bias said pressed end to the first position.

6. The safely operable handle device according to claim 5, wherein the reeling axis is transverse to the axial direction, said safely operable handle device further comprising a lever which includes a fulcrum with a fulcrum axis that is transverse to both the axial direction and the reeling axis, and a power region and a weight end that are at two opposite sides of said fulcrum, said weight end being integrally formed with said retaining finger such that pressing of said power region results in turning of said weight end about the fulcrum axis so as to enable said retaining end to disengage from one of said engaging holes.

7. The safely operable handle device according to claim 6, wherein said push button is mounted on and is movable relative to said lower wall in the axial direction, said actuating end and said force-transmitting end respectively having cam surfaces configured to mate with each other such that the stroke movement of said push button in the axial direction results in movement of said retaining finger in a transverse direction parallel to the reeling axis.

8. The safely operable handle device according to claim 6, further comprising a lower press button which is pressible manually to permit movement of said retained block from the first orientation to the second orientation, and to permit movement of said power region so as to result in turning of said weight end, thereby enabling said retaining end to disengage from one of said engaging holes.

9. The safely operable handle device according to claim 5, wherein the reeling axis is transverse to the axial direction, and said retaining finger has a fulcrum which is interposed between said retaining and force-transmitting ends such that pressing of said force-transmitting end results in turning of said retaining end about the fulcrum axis so as to enable said retaining end to disengage from one of said engaging holes.

10. The safely operable handle device according to claim 9, wherein said retaining finger further has a power region which extends from said force-transmitting end away from said fulcrum, said safely operable handle device further comprising a lower press button which is pressible manually to permit movement of said retained block from the first orientation to the second orientation, and to permit movement of said power region so as to result in turning of said retaining end, thereby enabling said retaining end to disengage from one of said engaging holes.

11. The safely operable handle device according to claim 9, wherein said push button is mounted on said barrel wall and is movable relative to said barrel wall in a transverse direction parallel to the reeling axis.

* * * * *